US006227532B1

(12) United States Patent
Bakoledis

(10) Patent No.: US 6,227,532 B1
(45) Date of Patent: May 8, 2001

(54) SHEET TURNOVER MECHANISM

(75) Inventor: Andrew Bakoledis, Chester, CT (US)

(73) Assignee: GBR Systems Corporation, Chester, CT (US)

( * ) Notice: Subject to any disclaimer, the term of this patent is extended or adjusted under 35 U.S.C. 154(b) by 0 days.

(21) Appl. No.: 09/336,561

(22) Filed: Jun. 21, 1999

(51) Int. Cl.[7] ..... B65H 5/00; B65H 15/00; B65H 29/16

(52) U.S. Cl. ..... 271/9.13; 271/186; 271/275; 271/303; 198/403; 198/406; 198/407; 198/433

(58) Field of Search ..... 271/9.13, 9.12, 271/186, 225, 275, 303, 305; 198/406, 407, 403, 433

(56) References Cited

U.S. PATENT DOCUMENTS

| | | | |
|---|---|---|---|
| 1,630,713 | 5/1927 | Meyer . | |
| 2,541,752 | 2/1951 | Eddy et al. . | |
| 3,215,428 | 11/1965 | Rehm . | |
| 3,334,723 | 8/1967 | Reed et al. . | |
| 3,436,073 | 4/1969 | Christmas . | |
| 3,548,783 | 12/1970 | Knapp . | |
| 4,019,435 | 4/1977 | Davis . | |
| 4,078,489 | 3/1978 | Davis . | |
| 4,204,671 | 5/1980 | Pessina et al. . | |
| 4,266,762 | 5/1981 | Kramer et al. . | |
| 4,277,060 | 7/1981 | Perobelli et al. . | |
| 4,367,997 | 1/1983 | Schweingruber . | |
| 4,368,973 | 1/1983 | Silverberg . | |
| 4,445,682 | 5/1984 | Uchida . | |
| 4,456,236 | 6/1984 | Buddendeck . | |
| 4,527,792 | 7/1985 | Burkhardt . | |
| 4,572,350 | 2/1986 | Besemann . | |
| 4,757,904 | 7/1988 | Ozawa . | |
| 4,790,126 | 12/1988 | Boeckmann . | |
| 4,815,722 | 3/1989 | Sugimoto . | |
| 4,844,442 | 7/1989 | Gammerler . | |
| 4,879,571 | 11/1989 | Plasscheart . | |
| 4,924,275 | 5/1990 | Nelson . | |
| 5,048,814 | 9/1991 | Svyatsky . | |
| 5,116,035 | 5/1992 | Russel et al. . | |
| 5,158,278 | 10/1992 | Auf Der Mauer . | |
| 5,180,154 | 1/1993 | Malick . | |
| 5,180,159 | 1/1993 | Malick . | |
| 5,188,355 | 2/1993 | Lowell et al. . | |
| 5,282,528 | 2/1994 | Hudson . | |
| 5,295,679 | 3/1994 | Reist . | |
| 5,316,199 | 5/1994 | Hansen et al. . | |
| 5,318,285 | 6/1994 | Edwards et al. . | |
| 5,333,851 | 8/1994 | Kulpa . | |
| 5,362,039 | 11/1994 | Kusters . | |
| 5,439,208 | 8/1995 | Moser et al. . | |
| 5,447,303 | 9/1995 | Smith . | |
| 5,449,166 | 9/1995 | Lohmann et al. . | |
| 5,575,465 * | 11/1996 | Auerbach et al. | 271/9.13 |
| 5,666,629 | 9/1997 | Kazoh . | |
| 5,692,746 | 12/1997 | Herrick, Jr. . | |
| 6,098,977 * | 8/2000 | Sato et al. | 271/186 |

* cited by examiner

*Primary Examiner*—John M. Jillions
(74) *Attorney, Agent, or Firm*—Joseph J. Previto

(57) ABSTRACT

A turnover mechanism for handling sheets having a pair of belts, said belts are spaced one above the other, sheet turnover tubes interposed between the two belts, one of the turnover tubes facing in a direction opposite to the other turnover tubes, the sheets being fed to one of the belts, the belt moving the sheets to a turnover tube whereby the turnover tube inverts the sheets and transfers the sheets from one belt to the other belt. The belts and turnover tubes are mounted in an invertable module.

10 Claims, 3 Drawing Sheets

SHEET TURNOVER MECHANISM

BACKGROUND

The present invention relates to a turnover mechanism and more particularly to an improved turnover mechanism for inverting sheets that are fed to it and re-routing the movement of the sheets from one direction to another direction.

In the printing of documents comprising a number of sheets, the sheets are fed from a printer to various mechanisms which perform certain operations on the sheets, including assembling the sheets together in a particular order. It often occurs that in presenting the individual sheets to the various mechanisms, the sheets must sometimes be inverted and/or the order in which they are printed may need to be reversed or changed. In addition, in view of the location of the various mechanisms which may perform additional operations on the sheets, it may be necessary to reroute the sheets to different directions.

A number of mechanisms have been devised which will invert sheets and present them to additional mechanisms which will perform other operations on them. However, existing machines do not have the necessary versatility to invert the sheets and present them to any additional mechanisms which will perform other functions on them in the order which a particular document requires. Depending on the location of the additional mechanism which will perform other operations on the sheets it sometimes necessary for the sheets to be removed from the turnover mechanism and physically move them to the other mechanisms.

OBJECTS

The present invention overcomes these difficulties and has for one of its objects the provision of an improved sheet turnover mechanism which is versatile.

Another object of the present invention is the provision of an improved turnover mechanism which will turn the sheets over and present them to other mechanisms in either the same order or the reverse order from which they are presented to the turnover mechanism.

Another object of the present invention is the provision of an improved turnover mechanism in which the same mechanism can present the sheets in the desired order.

Another object of the present invention is the provision of an improved turnover mechanism in which the same mechanism can route the sheets to different directions either in the same order in which they are presented to the turnover mechanism or in the reverse order.

Other and further objects will be obvious upon the understanding of the illustrative embodiment about to be described, or which will be indicated in the appended claims, and various advantages not referred to herein, will occur to one skilled in the art upon employment of the invention practice.

DRAWINGS

A preferred embodiment of the invention has been chosen for purposes of illustration and description and is shown in the accompanying drawings forming a part of the specification, wherein.

DESCRIPTION

Figure 1:
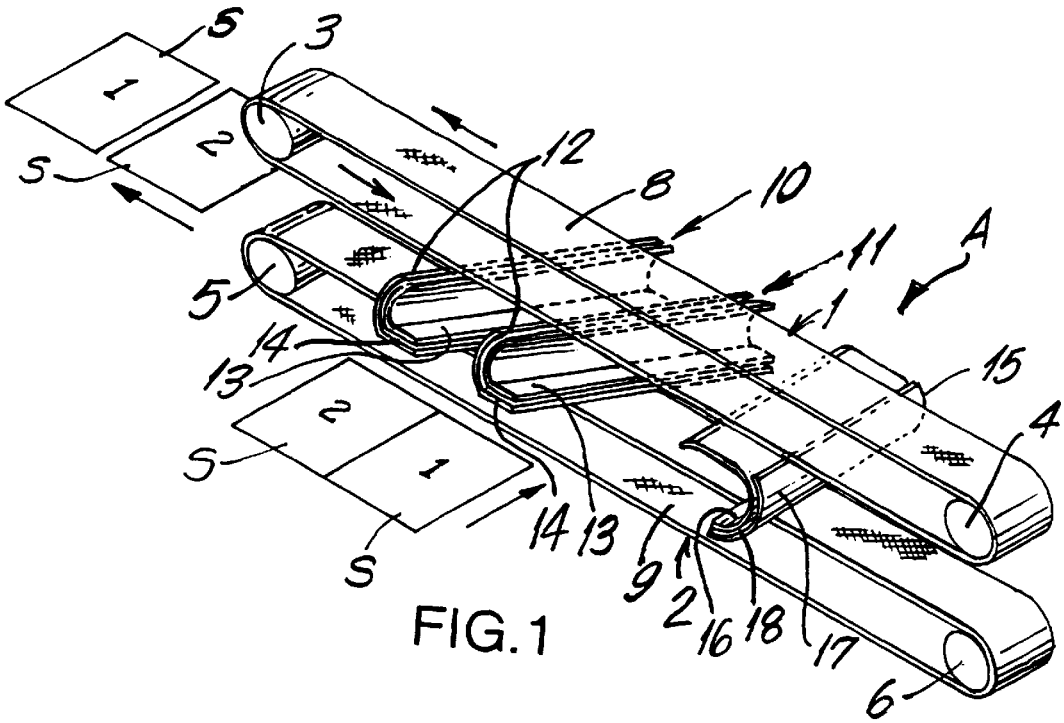
FIG. 1 is a simplified perspective view showing a turnover mechanism made in accordance with the present invention.
Figure 2:
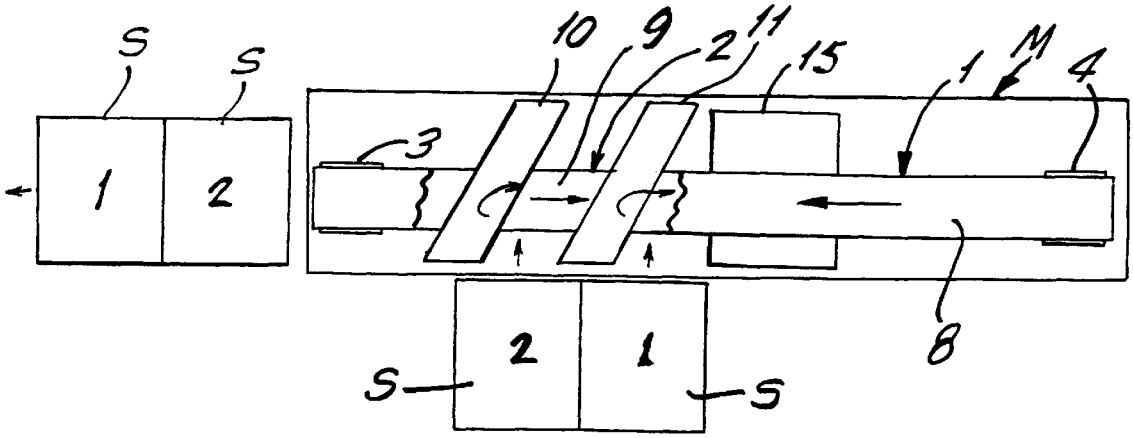
FIG. 2 is a top view thereof, partly broken away.
Figure 3:
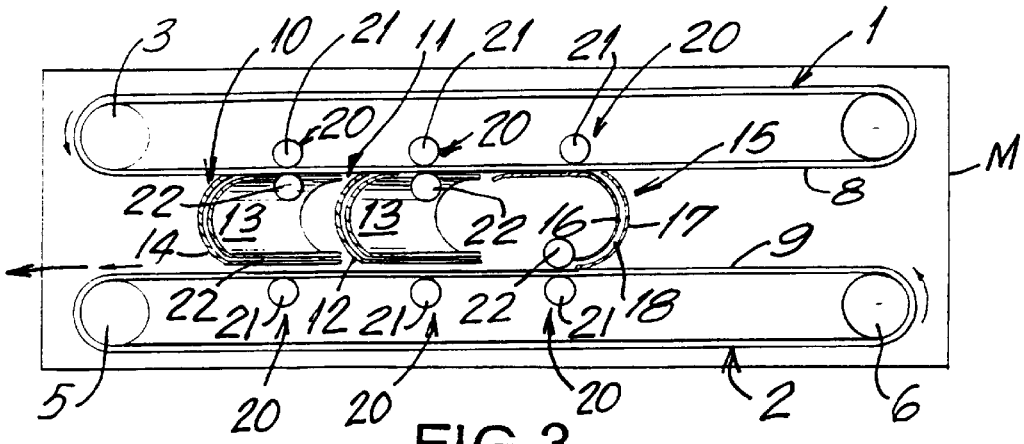
FIG. 3 is a simplified side view of the embodiment shown in FIGS. 1 and 2.

Referring to the drawings and more particularly FIGS. 1, 2 and 3, the turnover mechanism of the present invention is mounted on an invertible turnover module M and comprises a pair of upper and lower endless belt assemblies 1 and 2 stacked one on top of the other in spaced relationship to each other. The belt assemblies 1 and 2 comprise endless belts 8 and 9, respectively which are driven around rollers 3–4 and 5–6, respectively, by a suitable driving mechanism (not shown).

The belts 8 and 9 are shown as being driven in the same direction,i.e. the top and bottom runs of belts 9 and 8, respectively, in the same direction. A pair of first and second turnover tube assemblies 10 and 11 are interposed between the top and bottom belts 8 and 9. The turnover tube assemblies 10 and 11 are preferably comprised of a pair of curved members 12 and 13 which are spaced from each other to form a curved channel 14 therebetween which is open at both ends. Each channel 14 is adapted to receive a sheet S from the sheet feed mechanism at the discharge end of the printer, turn it upside-down and re-route it by delivering it to the upper belt 8. The turnover tube assemblies 10 and 11 are shown as facing to the right so that they will receive sheets S, invert them and re-route them to the right.

A third turnover tube assembly 15 is also provided between the belts 8 and 9. The turnover tube assembly 15 is shown as being a left-handed tube assembly 15 having a pair of curved spaced members 16–17 to form a channel 18 therebetween, all of which face to the left, i.e. opposite to the right-facing turnover tube assemblies 10 and 14. The member 17 is adjustable relative to element 16 to permit the channel 18 to be wider, narrower, or closed altogether.

A pair of sheets S are fed at right angles to the module M in the order 2-1 (i.e. sheet 2 is to the left of sheet 1) as shown in FIGS. 1 and 2. The two sheets S are fed to each turnover tube assembly 10 and 11. The sheets S are inverted (i.e. turned upside-down) by the turnover tube assemblies 12, exit from the top of the channel 14 and are fed to the lower run of the upper belt 8 which moves them to the right in the same order 2-1. Upper belt 8 feeds the sheets S to the upper top of the channel 18 in the third turnover tube assembly 15, which inverts them again and deposits them on the upper run of the lower belt 9. Here they move to the left and exit from the left hand side of the module M in the order 1-2.

To ensure that the sheets S enter into the channels .14 and 18 in the turnover tube assemblies 10, 11 and 15 divert roller assemblies 20 are provided adjacent the channels 14 and 18 at both the top and bottom of the channels. These divert roller assemblies are substantially similar to each other and comprise rollers 21 and 22. Each roller 21 is in contact with the inner surface of the belts 8 and 9 and each roller 22 is in contact with the outer surface thereof, (i.e. the rollers 21 contact the inner surfaces of the upper and lower runs of the belts 9 and 8 and the rollers 22 are in contact with the outer surface thereof). Each roller 22 extends from the members 12 and 16 of the turnover tube assemblies 10, 11 and 15. Each roller 21 is spring-pressed toward the belts by spring 23 on arm 24 so that each of the two rollers 21–22 bears on the belt which is between them. It will be noted that single rollers 22 are provided at the entrance to the tube assemblies to insure that the sheets S are positively directed into the channels 14 and 18 in the turnover tube assemblies 10, 11 and 15.

Figure 5:
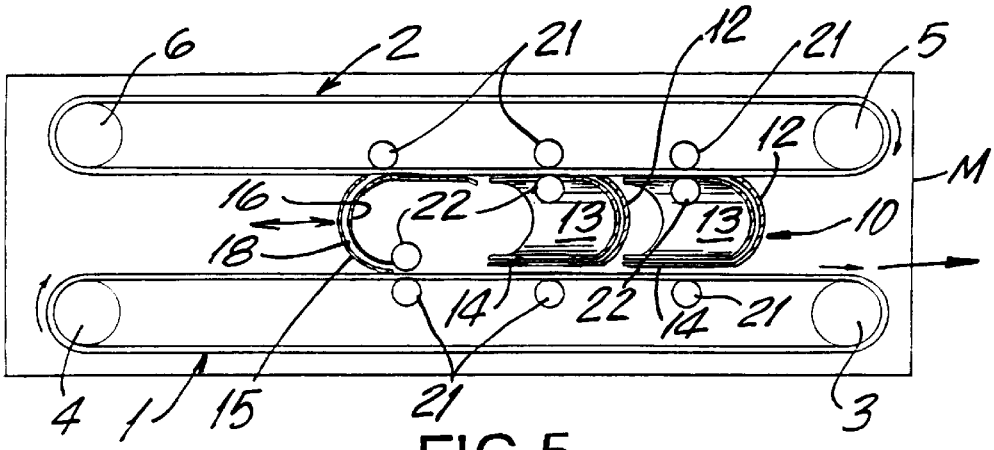
FIG. 5 is a simplified side view of another feature of the present invention.

It will be noted that in the embodiment shown in FIGS. 1 to 3 the sheets S leave the turnover module M through the left hand side thereof because other machines (not shown) which would perform additional operations on the sheets may be located on the left hand side of the turnover module M. However, where the other machines which perform additional operations on the sheets are located on the right hand side of the turnover module M, it is desirable for the sheets S to exit the module M from the right hand side. In order to do this, the entire turnover module M is inverted 180 degrees to the position as shown in FIG. 5. In this instance all the elements and operations are the reverse of the elements and operations shown in FIGS. 1 to 3 and the sheets S will exit from the right hand side of the turnover module M.

Figure 6:
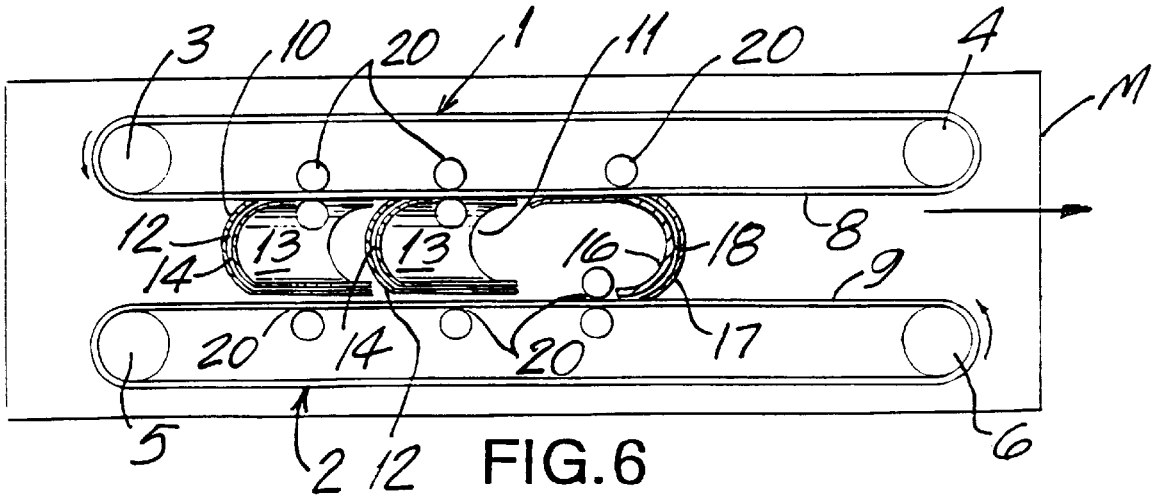
FIG. 6 is a simplified side view of still another feature of the present invention.

The present invention is also adapted to be used if inverting the sheets S a second time is not necessary. This is shown in FIG. 6. The channel 18 in turnover tube assembly 15 can be closed by moving the curved member 17 inwardly against the other curved member 16 to close the channel 18. The sheets S are fed by a sheet feeder to the first turnover tube assemblies 10–11 where they are inverted once and deposited on the upper belt 8. Since the channel 18 in the third turnover tube assembly 15 is closed, the sheets S will not enter that turnover tube channel 18. They will remain on the upper belt 8 to exit to the right of the module M. If it is desired that the sheets S exit from the left in this particular version, the entire turnover module M is inverted 180 degrees and the sheets S will now exit from the left.

Figure 7:
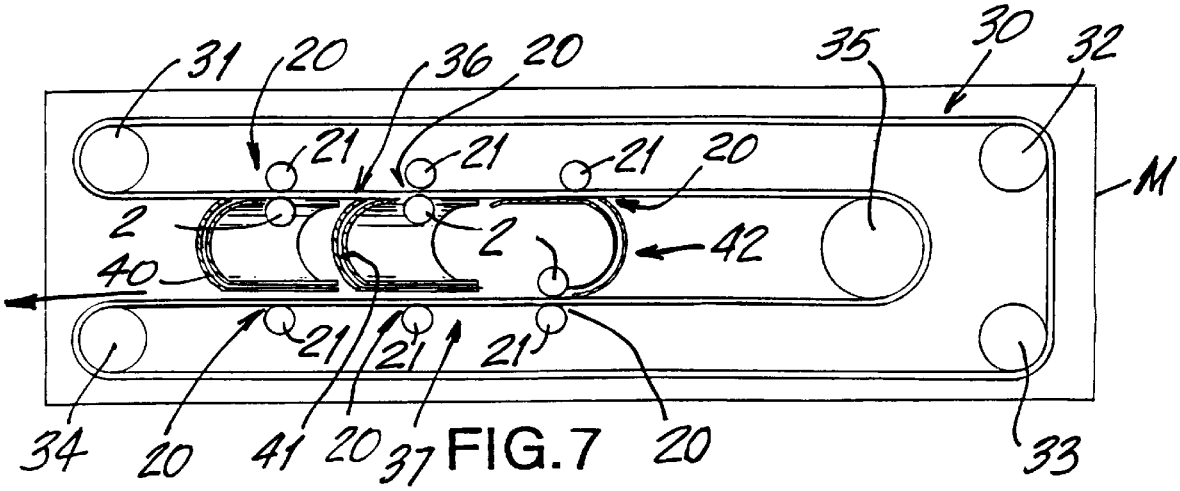
FIG. 7 is a simplified side view of a modification of the present invention.
Figure 4:
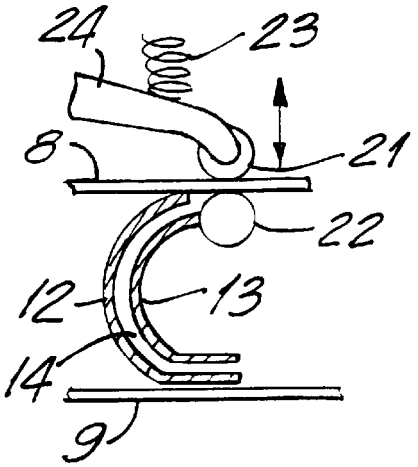
FIG. 4 is a detail of one feature of the present invention.

FIG. 7 shows another embodiment of the present invention. In this embodiment, a single serpentine belt 30 is provided in a turnover module M. It is separated into spaced upper and lower segments 36 and 37 by means of rollers 31 to 34 and by a separator roller 35. The belt 39 is operated by a suitable drive (not shown) and moves in one direction in its upper segment 36 and in the opposite direction in its lower segment 37. Turnover tube assemblies 40, 41 and 42 are similarly structured to the tube assemblies 10, 11 and 15 and are interposed between the upper and lower segments 36 and 37. In this embodiment, the sheets S are fed to the turnover tubes 40–41 by the lower segment 37 and are inverted and deposited on the upper segment 36. They then move to the right and enter the third turnover tube assembly 42 which will again invert them back and deposit them on lower segment 37. They then move to the left so as to exit from the left hand side of the turnover module M. If it is desired for the sheets to exit from the right hand side of the turnover module M, the entire turnover module M is inverted so that its operations are reversed and the sheets will exit from the right hand side of module M.

It will be seen that the present invention provides an improved sheet turnover mechanism which is versatile, which will turn the sheets over and present them to other mechanisms in either the same order or the reverse order from which they are presented to the turnover mechanism, in which the same mechanism can present the sheets in the desired order and in which the same mechanism can route the sheets to different directions either in the same order in which they are presented to the turnover mechanism or in the reverse order.

As many varied modifications of the subject matter of this invention will become apparent to those skilled in the art from the detailed description given hereinabove, it will be understood that the present invention is limited only as provided in the claims appended hereto.

What is claimed is:

1. A turnover mechanism for handling sheets comprising a pair of belt means, said belt means being spaced from each other, a sheet turnover means interposed between the two belt means, means for feeding sheets to one of said belt means, said belt means moving the sheets to said turnover means whereby the turnover means inverts the sheets and transfers the sheets from said one belt means to the other belt means, said belt means and said turnover means are mounted in an invertible module, at least two turnover means are mounted between the between the belt means and face in the opposite direction, and said turnover means are turnover tubes.

2. A turnover mechanism as set forth in claim 1 in which each turnover tube comprises a pair of curved members forming a channel therebetween.

3. A turnover mechanism as set forth in claim 2 which sheets are adapted to be moved in one direction by a belt means, said belt means adapted to move the sheets into the channel of the turnover tubes to be transferred to the other belt means, said other belt means moves said sheets in the opposite direction.

4. A turnover mechanism as set forth in claim 3 which one of the channels in said turnover tubes is adapted to be closed so that the sheets cannot enter therein.

5. A turnover mechanism as set forth claim 4 in which a divert roller assembly is mounted adjacent each turnover tube.

6. A turnover mechanism as set forth in claim 5 in which the divert roller comprises a pair of rollers in contact with opposite sides of the belt means.

7. A turnover mechanism as set forth in claim 6 in which one of said divert rollers is mounted on turnover tubes and the other divert roller is mounted opposite thereof on a spring-pressed arm which is biased towards the belt.

8. A turnover mechanism as set forth in claim 7 in which means are provided to said module 180 degrees whereby the operations are reversed.

9. A turnover mechanism as set forth in claim 8 in which the belt means are separate belts spaced one above other.

10. A turnover mechanism as set forth in claim 8 in which said belt means in a serpentine belt having spaced belt segments.

* * * * *